US005677721A

United States Patent [19]

Suzuki et al.

[11] Patent Number: 5,677,721

[45] Date of Patent: Oct. 14, 1997

[54] THERMAL PRINTER HEAD DRIVING SYSTEM

[75] Inventors: Minoru Suzuki; Kiyoshi Negishi; Katsumi Kawamura; Mikio Horie; Hiroshi Orita; Katsuyoshi Suzuki, all of Tokyo, Japan

[73] Assignee: Asahi Kogaku Kogyo Kabushiki Kaisha, Tokyo, Japan

[21] Appl. No.: 489,140

[22] Filed: Jun. 9, 1995

[30] Foreign Application Priority Data

Jun. 9, 1994 [JP] Japan ..... 6-151485

[51] Int. Cl.[6] ..... B41J 2/36; B41J 2/365

[52] U.S. Cl. ..... 347/190

[58] Field of Search ..... 347/180, 188, 347/190, 181, 182; 400/120.09, 120.1, 120.05, 120.06; 395/108; 358/501, 502, 503

[56] References Cited

U.S. PATENT DOCUMENTS

| | | | |
|---|---|---|---|
| 4,510,505 | 4/1985 | Fukui | 347/190 |
| 4,510,507 | 4/1985 | Ishikawa | 347/190 |
| 4,563,691 | 1/1986 | Noguchi et al. | 347/190 |
| 4,616,941 | 10/1986 | Nagai | 347/190 |
| 4,761,659 | 8/1988 | Negishi . | |
| 4,875,056 | 10/1989 | Ono | 347/190 |
| 4,879,459 | 11/1989 | Negishi . | |
| 4,967,205 | 10/1990 | Sakaguchi et al. | 347/190 |
| 5,109,255 | 4/1992 | Nishikawa et al. . | |
| 5,382,101 | 1/1995 | Iguchi | 400/120.1 |
| 5,408,483 | 4/1995 | Kasai et al. . | |

*Primary Examiner*—Huan H. Tran

*Attorney, Agent, or Firm*—Greenblum & Bernstein, P.L.C.

[57] ABSTRACT

A thermal printer for forming an image on a sheet includes a thermal head having a plurality of linearly arranged thermal elements. A number of thermal elements to be driven to form a line image is determined. A time period that the thermal elements are to be driven to form the current line image is then calculated in accordance with a number of thermal elements driven to form a previous line image and the number of thermal elements determined to be driven to form the current line image. The thermal elements are then driven for the calculated time period to form the current line image.

22 Claims, 6 Drawing Sheets

I / F
27
PDATA1~8
DATASTB
BUSY
ACK
LED
107
108
109
GND
G / A
26
40
41
THERMAL HEAD
CLK
DATA1
DATA2
CHARGE CONTROL CCT.
60
70
CC
CV
GND
80
81
82
90
Batt.
POWER SW
106
51
52
53
VCC
ADPT.IN
32
M
31
MOTOR DRIVE CCT.
VH
SW
DC/DC CONVERTER
50
V−Batt
X'tal
15
STB1
STB2
STB3
STB4
CHARGE
REFRESH
CPU
AB
DB
AB23~0
DB15~0
AN1
Port1
Port2
Port3
Port4
Port5
Port6
A
Ā
B
B̄
Port7
PON2
PON1
Port 8
AN2
RESET
PTOP
10
RESET IC
24
25
EPROM
21
DRAM
22
ROM
23

THERMAL PRINTER HEAD DRIVING SYSTEM

BACKGROUND OF THE INVENTION

The present invention relates to a system for energizing linearly arranged thermal elements of a thermal head of a printer to perform an imaging operation.

Conventionally, thermal printers have a printing head with linearly arranged thermal elements which are energized to form an image on a thermosensitive paper. Generally, the thermal elements are divided into a plurality of groups, with each group of thermal elements being energized separately. By feeding the thermosensitive paper at a predetermined speed, and energizing each group of thermal elements at predetermined time intervals, a two-dimensional image is formed on the paper.

In a prior art thermal printer, when a line that is printed has a low printing ratio (i.e., a small number of thermal elements are energized), the thermal head does not output a large amount of heat. If the next line to be printed has a much higher printing ratio, then the image formed may be too light, since the thermal line head is cool from the previous line, and therefore the amount of heat output by the thermal elements is less than required. This results in an uneven image being formed.

SUMMARY OF THE INVENTION

It is therefore an object of the present invention to provide an improved thermal printer which can form an image having a uniform darkness even if the printing ratio of lines changes considerably.

According to an aspect of the present invention, there is provided a thermal printer for forming an image on a sheet. The thermal printer includes a thermal head having a plurality of linearly arranged thermal elements. A number of thermal elements to be driven to form a line image is determined. Then a time period that the thermal elements are driven to form the current line image is calculated in accordance with a number of thermal elements driven to form a previous line image and the number of thermal elements determined to be driven to form the current line image. The thermal elements are then driven for the calculated time period in order to form the current line image.

Therefore, the time interval that the thermal elements are driven depends on the number of thermal elements driven previously, as well as the number of thermal elements that are to be driven to form the current line.

Preferably, the thermal printer includes a mechanism for storing the number of thermal elements driven to form the previous line.

In a preferred embodiment, if the determined number is not greater than the stored number by a predetermined amount, the time interval is set to a first predetermined time value.

In this case, there is enough residual heat in the thermal head to ensure uniform printing of the current line, and therefore no additional time is needed to drive the thermal elements.

However, if the determined number is greater than the stored number by the predetermined amount, the time interval is set equal to a second predetermined time value, the second predetermined time value being greater than the first predetermined time value.

In this case, there is insufficient residual heat in the thermal head to ensure uniform printing of the current line, and therefore additional time is needed to drive the thermal elements.

Further, the second predetermined time value is equal to the first predetermined time value multiplied by a compensation ratio. The compensation value is a value greater than 1.

In another preferred embodiment, the thermal printer includes a first and second storing mechanism. The first storing mechanism stores a first number of thermal elements driven to form a previously printed line, and the second storing mechanism stores a second number of thermal elements driven to form a line before the previously printed line.

Further, the time interval that the thermal elements are driven is calculated in accordance with whether the determined number of thermal elements to be driven is larger by the predetermined amount, than the first stored number of thermal elements, and whether the determined number of thermal elements to be driven is larger by the predetermined value, than the second stored number of thermal elements.

If the determined number is not greater than the first stored number by the predetermined amount, and the determined number is not greater than the second stored number by the predetermined amount, the time interval is set to a first predetermined time value.

In this case, there is enough residual heat in the thermal head to ensure uniform printing of the current line, and therefore no additional time is needed to drive the thermal elements.

However, if the determined number is greater than the first stored number by the predetermined amount, and the determined number is not greater than the second stored number by the predetermined amount, the time interval is set equal to a second predetermined time value, the second predetermined time value being greater than the first predetermined time value.

Further, the second predetermined time value is equal to the first predetermined time value multiplied by a first compensation ratio. The first compensation ratio is a value greater than 1.

In this case, there is insufficient residual heat in the thermal head to ensure uniform printing of the current line, and therefore additional time is needed to drive the thermal elements.

Further, if the determined number is greater than the first stored number by the predetermined amount, and the determined number is greater than the second stored number by the predetermined amount, the time interval is set equal to a third predetermined time value, the third predetermined time value being greater than the second predetermined time value.

Furthermore, the third predetermined time value is equal to the second predetermined time value multiplied by a second compensation ratio. The second compensation ratio is also greater than 1.

In this case, there is even less residual heat in the thermal head, than the previous case, and therefore uniform printing of the current line cannot be ensured. Thus, an even longer time is needed to drive the thermal elements, than in the previous case.

According to another aspect of the present invention, there is provided method of controlling a driving of a thermal head of a printer for forming an image on a sheet, the thermal head having a plurality of linearly arranged thermal elements, the method comprising the steps of:

counting a number of thermal elements to be driven to form a line of the image to be printed;

storing at least one number of the thermal elements driven to form at least a previously printed line of the image;

determining a time interval for driving the thermal elements, the time interval determined in accordance with whether the counted number of thermal elements to be driven is larger than the at least one stored number of thermal elements by a predetermined value; and driving the thermal elements for the time interval that are to be driven to form the line of the image to be printed.

DESCRIPTION OF THE EMBODIMENTS

Figure 1:
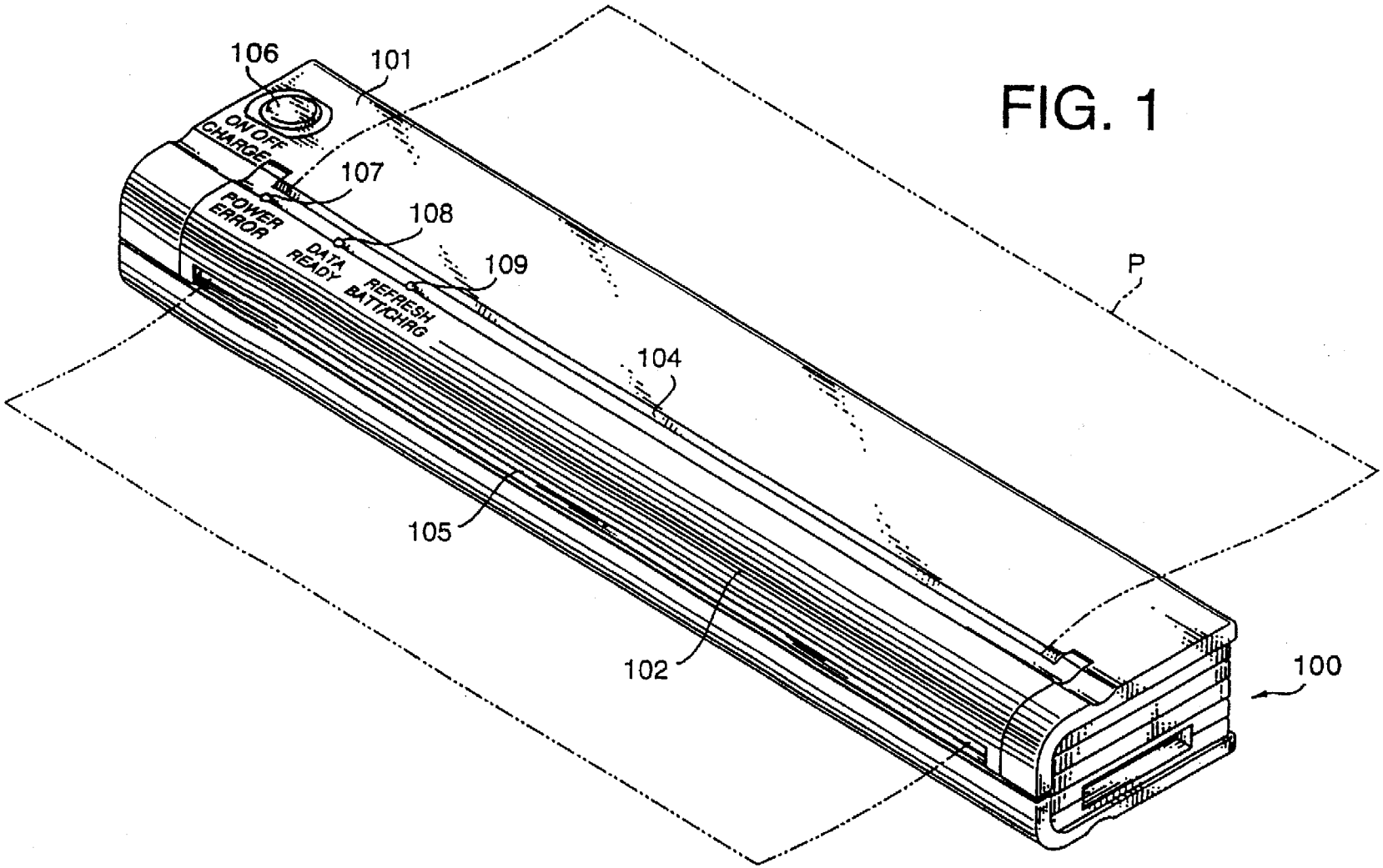
FIG. 1 shows a perspective view of a thermal printer embodying the present invention.

FIG. 1 is a perspective view of a thermal printer 100 embodying the mode control system according to the present invention. The thermal printer 100 has a main housing 101, and a platen roller cover 102. The platen roller cover 102 is hinged, and can swing to expose a platen roller (not shown).

Three indicators 107, 108 and 109 are formed on a top surface of the platen roller cover 102. In this embodiment, the three indicators 107, 108 and 109 are LEDs. The indicator 107 indicates whether the power is ON or OFF. The indicator 108 indicates whether data is being received. The indicator 109 indicates information about the operation of a built-in battery (not shown), such as whether the built-in battery is being refreshed (i.e., completely discharged) or charged.

Paper for use with the thermal printer 100 is fed into a slot 104 formed between the platen roller cover 102 and the housing 101. An image is formed on the paper using a thermal printing head 41 (see FIG. 2). The paper then exits the thermal printer 100 through a slot 105, formed between the platen roller cover 102 and the housing 101.

A mode switch 106 is located on the top surface of the housing 101. The mode switch 106 is a push button switch and is normally open. By pressing the mode switch 106, various modes of operation of the thermal printer 100 are selected. In the present embodiment, the mode switch 106 also turns the power ON and OFF.

Figure 2:
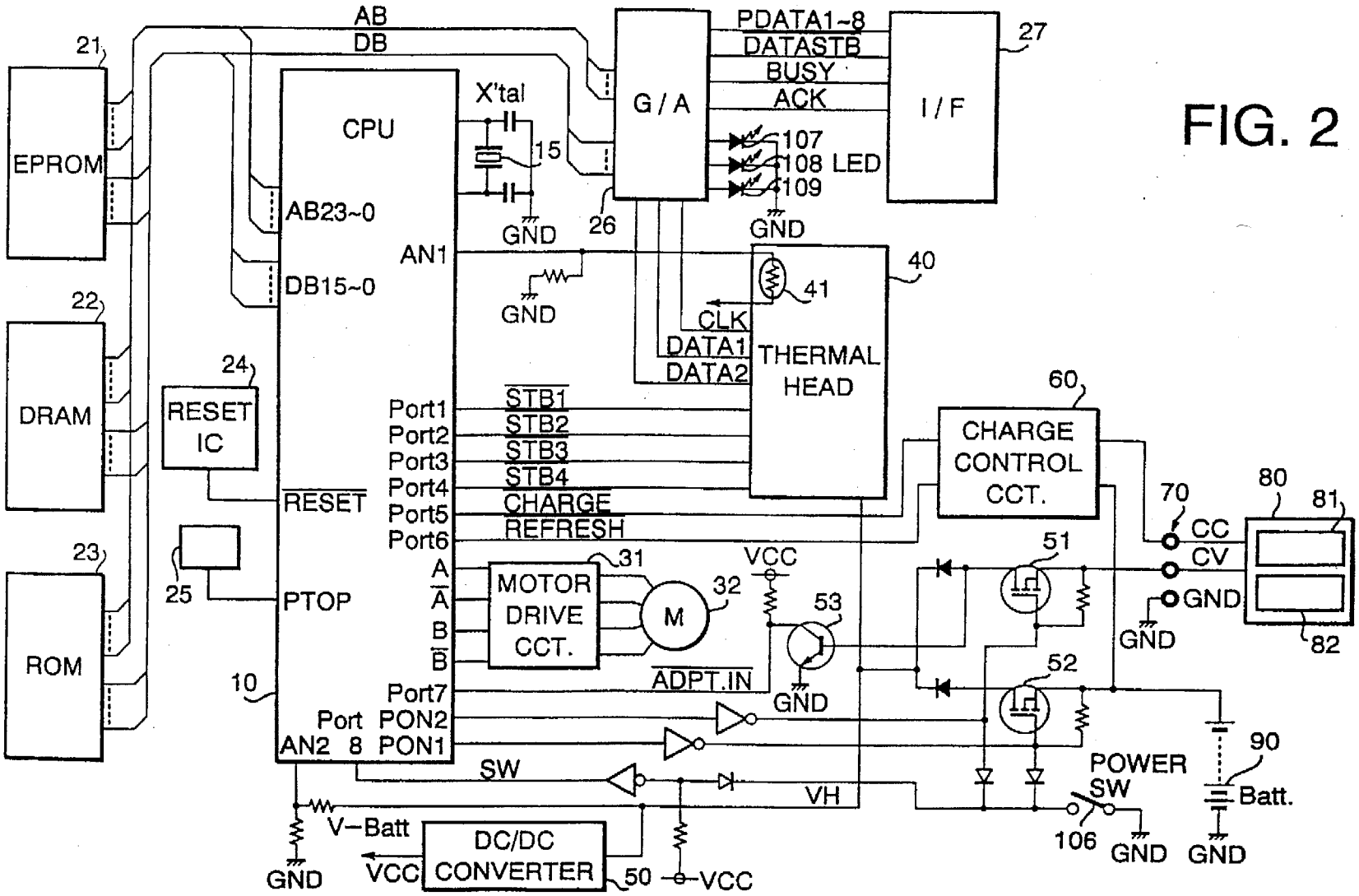
FIG. 2 shows a schematic diagram of the thermal printer shown in FIG. 1.

FIG. 2 is a schematic diagram of the thermal printer 100 shown in FIG. 1.

A CPU 10 controls an operation of the thermal printer 100. In the present embodiment, the CPU 10 is a microprocessor which can address up to 16 MB (megabytes). The CPU 10 transmits address information from address ports AB0 through AB23, along an address bus AB. The CPU 10 transmits and receives data through data ports DB0 through DB15 and a data bus DB. The CPU 10 connects to an EPROM 21, a DRAM 22, a font ROM 23, and a gate array 26, via the address bus AB and data bus DB.

The EPROM 21 stores data and software that controls printer performance, as well as an initial operation when the power is turned ON. The DRAM 22 (dynamic RAM) has an area where a bit-map of the image is developed, an area for storing data transmitted through an interface 27, and some other work areas. The font ROM 23 stores font data used for developing the bit-mapped image stored in the DRAM 22.

The CPU 10 uses a gate array 26 to exchange data through the interface 27, and drive the indicators 107, 108 and 109.

The interface 27 is a printer interface (e.g. Centronics interface) which receives print data and control data from a host computer (not shown). The printer interface has eight data lines PDATA 1 through PDATA 8, and three control lines $\overline{\text{DATASTB}}$, BUSY, and ACK. The eight data lines PDATA 1 through PDATA 8 transfer the print data from the host computer. The $\overline{\text{DATASTB}}$ control line inputs of data to the printer 100 from the host computer. The BUSY control line indicates that the printer 100 cannot accept the print data, while the ACK control line acknowledges reception of the print data. In the specification, a control line, port or signal having a "bar" over its name indicates an active low control line, port or signal, respectively.

A divided voltage V_BATT of the built-in battery (or an external DC voltage) is applied to an analog port AN2 of the CPU 10. The CPU 10 A/D converts the applied analog voltage to a digital value, and detects the voltage of the built-in battery (or external DC source).

A reset IC 24 transmits a reset signal ($\overline{\text{RESET}}$) to a CPU port $\overline{\text{RESET}}$, when the detected voltage level of the battery is lower than a predetermined voltage level. When the $\overline{\text{RESET}}$ signal is LOW, the CPU 10 stops operation of the printer 100. Therefore, the printing operation stops when the voltage of the built-in battery (or external DC voltage) is below the predetermined level.

A sensor 25 mounted on the platen roller cover 102, detects the presence of the thermosensitive paper in a sheet feed path of the printer 100. If the thermosensitive paper is located in the sheet feed path, the sensor 25 transmits a paper-detect signal to a port PTOP of the CPU 10. By monitoring the port PTOP, the CPU 10 determines whether the printer 100 has thermosensitive paper loaded in the sheet feed path, and therefore whether the printer 100 is ready to start the printing operation.

A reference clock signal CLK is generated by crystal 15. In accordance with the reference clock signal CLK, the bit map of the print data is developed in the DRAM 22. The data written in the DRAM 22 is transmitted to the gate array 26 and synchronized with the reference clock signal CLK, before being transferred to the thermal print head 40. The data transferred to the thermal head 40 is separated into two separate data blocks: DATA1 and DATA2.

The thermal print head 40 has a plurality of thermal elements. The heat energy generated by each of the thermal elements is controlled by strobe signals $\overline{\text{STB1}}$, $\overline{\text{STB2}}$, $\overline{\text{STB3}}$, $\overline{\text{STB4}}$ (described later), which are transmitted from the ports Port 1 through Port 4 of the CPU 10. Thus, DATA1 and DATA2 identify the thermal elements to be driven, and strobe signals $\overline{\text{STB1}}$ through $\overline{\text{STB4}}$ drive the identified thermal elements to generate the required heat energy for printing the image.

A thermistor 41 is provided on the thermal head 40 for detecting the temperature of the thermal head 40. The output of the thermistor 41 is input to a port AN1 of the CPU 10. The CPU 10 A/D converts the signal input to the port AN1, and detects the temperature of the thermal head 40.

A motor driving signal is transmitted from ports, A, $\overline{\text{A}}$, B, $\overline{\text{B}}$, for controlling a motor driving circuit 31. The motor driving circuit 31 drives a motor 32. The motor driving circuit 31 will be described in more detail later.

A port PON1 outputs a signal for turning ON or OFF a FET 52. A port PON2 outputs a signal for turning ON or OFF a FET 51. If an external power source (such as an AC adapter) is used to power the printer 100, a transistor 53 is turned ON, thereby changing the signal $\overline{\text{ADPT.IN}}$ from High to Low. The CPU 10 monitors the $\overline{\text{ADPT.IN}}$ signal at Port 7, and determines whether the external power supply is connected. If the external power supply is connected (i.e., $\overline{\text{ADPT.IN}}$ is Low), then the CPU 10 drives the FET 51 through port PON2. If the external power supply is not connected (i.e., $\overline{\text{ADPT.IN}}$ is High), then the CPU 10 drives the FET 52 through port PON1.

When the switch 106 is first turned ON, the FET 51 or 52 is turned ON, as described above. Power is supplied from the external power source or the built-in battery to a DC/DC converter 50. The DC/DC converter 50 outputs Vcc which powers the CPU 10, the EPROM 21, the DRAM 22 and the ROM 23. In this embodiment, Vcc=5V.

When the FETs 51 and 52 are turned OFF by the signals output from the Ports PON1 and PON2, power is not supplied to the DC/DC converter 50. Therefore, the power to the CPU 10 is cut-off and the printer 100 is turned OFF. In order to turn the printer 100 ON, it is necessary to press the switch 106 again, thereby providing power to the FETs 51 and 52.

The built-in battery 90 is a rechargeable battery, such as a Nickel Cadmium battery. The battery 90 supplies 14.4 VDC to the printer 100. A power source connector 70 is provided to connect the external power source, such as an AC adapter 80, to the printer 100. The AC adapter 80 includes a constant current source 81 and a constant voltage source 82. An output of the constant current source 81 is connected to a battery charge control circuit 60, and is used to recharge the battery 90. An output of the constant voltage source 82, is connected to an input of the DC/DC converter 50.

As described above, the constant current source 81 is part of the AC adapter 80, and not in the printer 100, since the constant current source 81 is only required for charging the battery. Therefore, the size and weight of the printer 100 is reduced.

To maximize the efficiency of charging the battery 90, the battery 90 is first refreshed (completely discharged) before being recharged. This reduces the 'memory' effect of the battery 90. The memory effect of a battery occurs when the battery is recharged without first being fully discharged. That is, if the battery is repeatedly recharged without being fully discharged, the available battery capacity is reduced.

In the present embodiment, the refreshing of the battery 90 is controlled by the charging circuit 60. When the battery is to be refreshed, the CPU 10 transmits a $\overline{\text{REFRESH}}$ signal from the Port 6 to the charge control circuit 60. The charge control circuit 60 stops charging the battery 90. The FET 51 is turned OFF, and the FET 52 is turned ON. The FET 52 connects the battery 90 to a load (not shown) to refresh the battery 90.

In the present embodiment, charging of the battery 90 is also controlled by the charging circuit 60. When the battery is to be charged, the CPU 10 transmits a $\overline{\text{CHARGE}}$ signal from the Port 5. The charge control circuit 60 starts charging the battery 90 using the constant current source 81 of the AC adapter 80. The voltage of the battery 90 is monitored by the CPU 10, to determine when to stop the charging operation.

The thermal head 40 has 2560 thermal elements arranged along a line, having a length equivalent to a width of one sheet of the thermosensitive paper used in the printer 100. Print data for the first through the 1280st thermal element are grouped as the DATA1, while print data for the 1281st through the 2560th thermal element are grouped as the DATA2. Further, as described above, the data DATA1 and DATA2 are transferred to the thermal head 40 synchronously with the reference clock signal CLK.

The thermal elements are divided into four groups, with each group driven by the strobe signals $\overline{\text{STB1}}$, $\overline{\text{STB2}}$, $\overline{\text{STB3}}$, and $\overline{\text{STB4}}$, respectively. With this arrangement the number of thermal elements driven at one time may be varied in accordance with the power available form the battery 90. If the power available from the battery 90 is low, then each group of thermal elements may be driven sequentially. However, if the battery 90 is fully charged or the AC adapter 80 is used, all four groups of thermal elements may be driven simultaneously.

Figure 3:
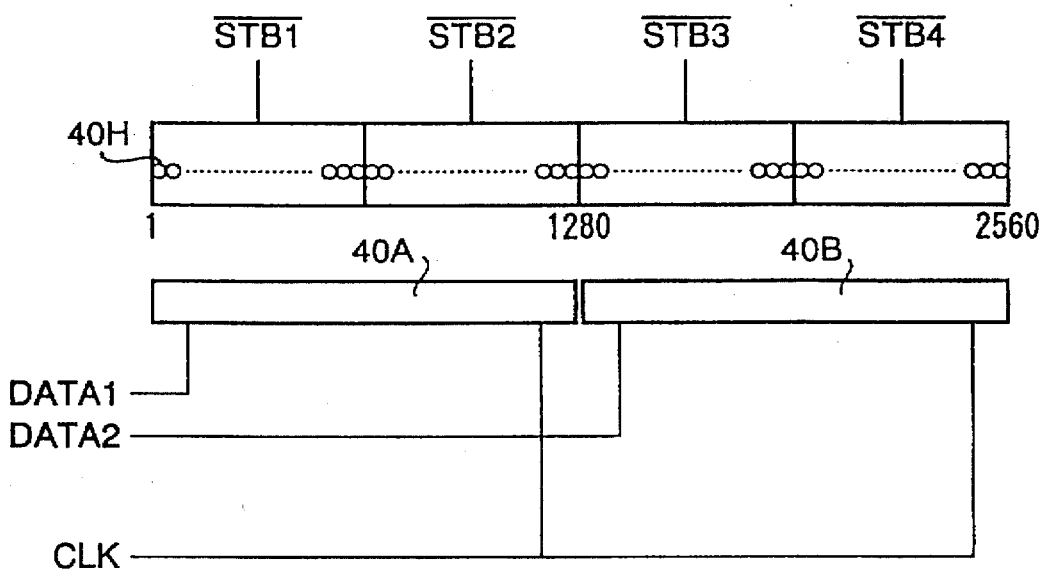
FIG. 3 shows a structure of a thermal head of the thermal printer shown in FIG. 1.

FIG. 3 illustrates a structure of the thermal head 40. Data used to drive the first through 1280th thermal elements 40H is sent from CPU 10 to the shift register 40A synchronously with the clock signal CLK. Similarly data used to drive the 1281st through 2560th thermal elements 40H is sent from the CPU 10 to the shift register 40B synchronously with the clock signal CLK. Each bit of the shift registers 40A and 40B store data which drives one of the thermal elements 40H. If the data value of the bit stored in the shift register is "1", then the corresponding thermal element is driven (i.e., turned ON) when the strobe signal $\overline{\text{STBn}}$ is LOW.

Figure 4:
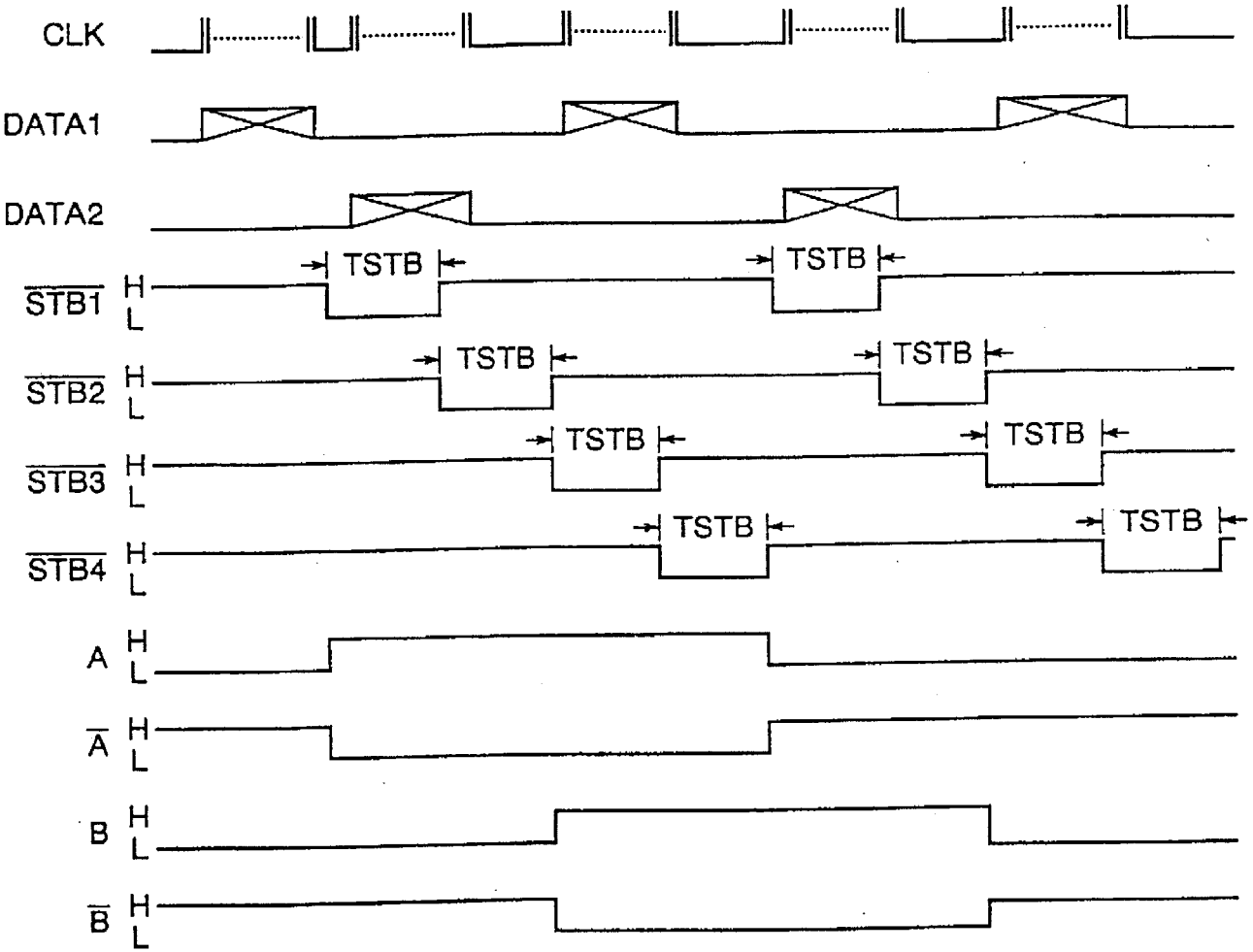
FIG. 4 is a timing diagram of the control of the thermal head and motor.

FIG. 4 is a timing diagram showing the transfer of data to the thermal head 40, the driving of the thermal head 40 and the driving of the motor 32.

After a bit map has been developed in the DRAM 22, the data to be printed by the thermal elements 40H is transmitted from the gate array 26 to the shift registers 40A and 40B. Initially DATA1 which corresponds to the data to drive the first through 1280th thermal elements 40H is transmitted synchronously with the clock signal CLK, and stored in the shift register 40A. After DATA1 has been stored, DATA1 is divided into two blocks, BLOCK1 and BLOCK2. Further, the thermal elements 40H are divided into two groups and driven in accordance with the data in BLOCK1 and BLOCK2, respectively. The first group (i.e., the first through 640th thermal element) is driven when the strobe signal $\overline{\text{STB1}}$ is made LOW for a predetermined time interval TSTB. Further, the motor 32 is driven to feed the thermal sheet a predetermined amount, when $\overline{\text{STB1}}$ changes from HIGH to LOW. Further, DATA2 which corresponds to the data to drive the 1281st through 2560th thermal elements, is transmitted synchronously during the first time interval TSTB, and stored in the shift register 40B.

When the strobe signal $\overline{\text{STB1}}$ changes from LOW to HIGH, the strobe signal $\overline{\text{STB2}}$ is made LOW and the second group of thermal elements (i.e., the 641st through 1280th) is driven for a predetermined period TSTB.

After driving the strobe signals $\overline{\text{STB1}}$ and $\overline{\text{STB2}}$, DATA2, which is stored in shift register 40B is transferred to the 1281st through 2560th thermal elements. DATA2 is also divided into two blocks, BLOCK3 and BLOCK4, respectively. Similarly, the thermal elements 40H are divided into two groups, and driven in accordance with the data stored in BLOCK3 and BLOCK4, respectively.

The third group (i.e., the 1281st through 1920th thermal element) is driven when the strobe signal $\overline{\text{STB3}}$ is LOW during a third time interval TSTB. Further, DATA1, which corresponds to the data to drive the first through 1280th thermal element for the image to be printed on the subsequent line, is transmitted synchronously during the third time interval TSTB, and stored in the shift register 40A. When the strobe signal $\overline{STB3}$ changes from LOW to HIGH, the strobe signal $\overline{STB4}$ is made LOW and the fourth group of thermal elements (i.e., the 1921st through 2560th) is driven during a fourth time interval TSTB.

The printing process repeats as described above, until all the data has been printed.

In the present embodiment, a two phase exciting method is used to drive the motor 32. Motor driving pulses A, $\overline{A}$, B, and $\overline{B}$ are sent from the CPU 10 to the motor 32 in one of two states, HIGH or LOW. Initially the states of the motor driving pulses are as follows: A=LOW, $\overline{A}$=HIGH, B=LOW, and $\overline{B}$=HIGH. When the states of two of the motor driving pulses (i.e., A and $\overline{A}$) are changed, the motor 32 feeds the thermal printer half a line. As shown in FIG. 4, the states of driving pulses A and $\overline{A}$ are changed while the strobe signals $\overline{STB1}$ and $\overline{STB2}$ are LOW. Then, while the strobe signals $\overline{STB3}$ and $\overline{STB4}$ are LOW, the states of motor driving pulses B and $\overline{B}$ are changed, and the motor 32 feeds the thermal paper another half line. The thermal printer is then ready to accept the next set of data to be printed.

If the data to be printed (i.e., DATA1 or DATA2) has a printing ratio which is higher than a printing ratio of the previously printed line by a predetermined amount, then the driving of the strobe signals $\overline{STB1}$, $\overline{STB2}$, $\overline{STB3}$, and $\overline{STB4}$ is modified as described below.

Figure 5:
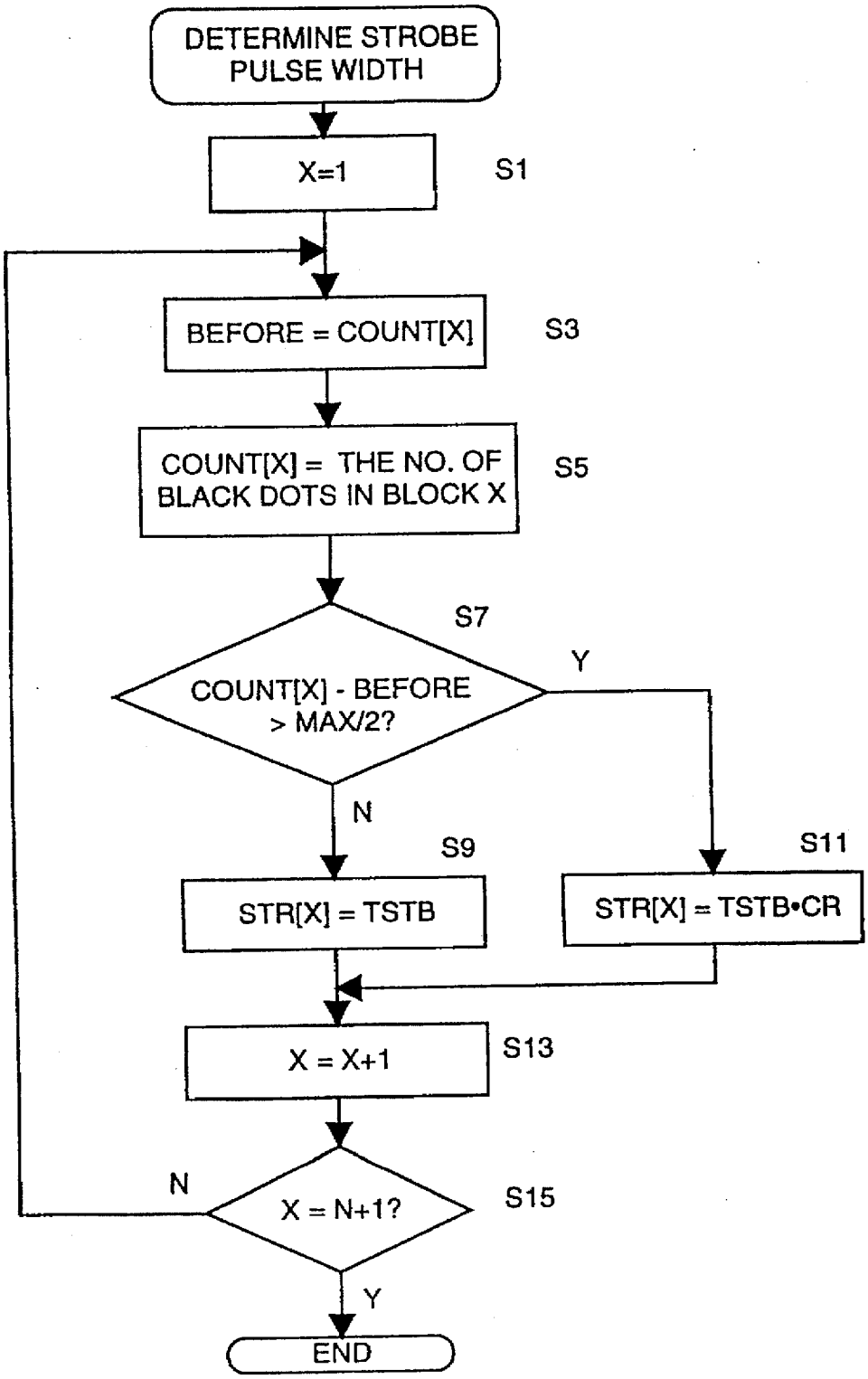
FIG. 5 shows a flowchart of a printing operation of the thermal printer according to an embodiment of the present invention.

FIG. 5 shows a flowchart of a process for determining a strobe pulse width of the strobe signals $\overline{STB1}$, $\overline{STB2}$, $\overline{STB3}$, and $\overline{STB4}$. In this embodiment, the strobe pulse width is determined in accordance with the number of thermal elements 40H that are to be driven in each block (i.e., BLOCK1 through BLOCK4) of data.

In each of the blocks BLOCK1 through BLOCK4, the number of thermal elements 40H to be driven to form the next line to be printed, is represented by COUNT[X], where X=1 through 4.

Initially, step S1 sets x=1. Then in step S3, BEFORE is set equal to COUNT[X]. In this case X=1 and therefore BEFORE is set equal to the present value of COUNT[1]. If this is the first line to be printed then COUNT[X] is equal to 0, and therefore BEFORE=0.

In step S5, the number of black dots to be printed corresponding to the data in BLOCK1 is determined, by examining the data. Then COUNT[1] is set equal to the number of black dots to be printed, in step S7.

In the present embodiment, the number of thermal elements that can be driven for each block is denoted by the term MAX. Step S7 determines whether COUNT[1] is larger than BEFORE by an amount equal to or greater than MAX/2. If COUNT[1]−BEFORE≧MAX/2 (S7:Y), then the strobe pulse width STR[1] is set equal to TSTB X CR in step S11, where CR>1. CR is a correction factor, which increases the strobe pulse width, thereby increasing the heat produced by the thermal head 40. If COUNT[1]−BEFORE<MAX/2 (S7:N), then the strobe pulse width STR[1] is set equal to TSTB in step S9 (i.e., STR[1] remains unchanged).

Then in step S13, the value of X is incremented by 1. Step S15 determines whether X=N+1, where N is the number of blocks of data (i.e., in this embodiment, N=4). If X is less than N+1 (S15:N), the above steps S3 through S15 are repeated. Otherwise the process ends.

As described above, the strobe pulse width STR[X] is modified if the number of black dots to be printed in a block of the current line is larger, by a predetermined amount, than the number of black dots printed in the same block of the previous line. The number of thermal elements driven is directly related to the number of black dots in the block. Therefore, by comparing the number of black dots in the block to be printed in the current line with the number of black dots printed for the previous line, it can be determined if the strobe pulse width should be increased to compensate for the low residual heat of the thermal head 40.

Figure 6:
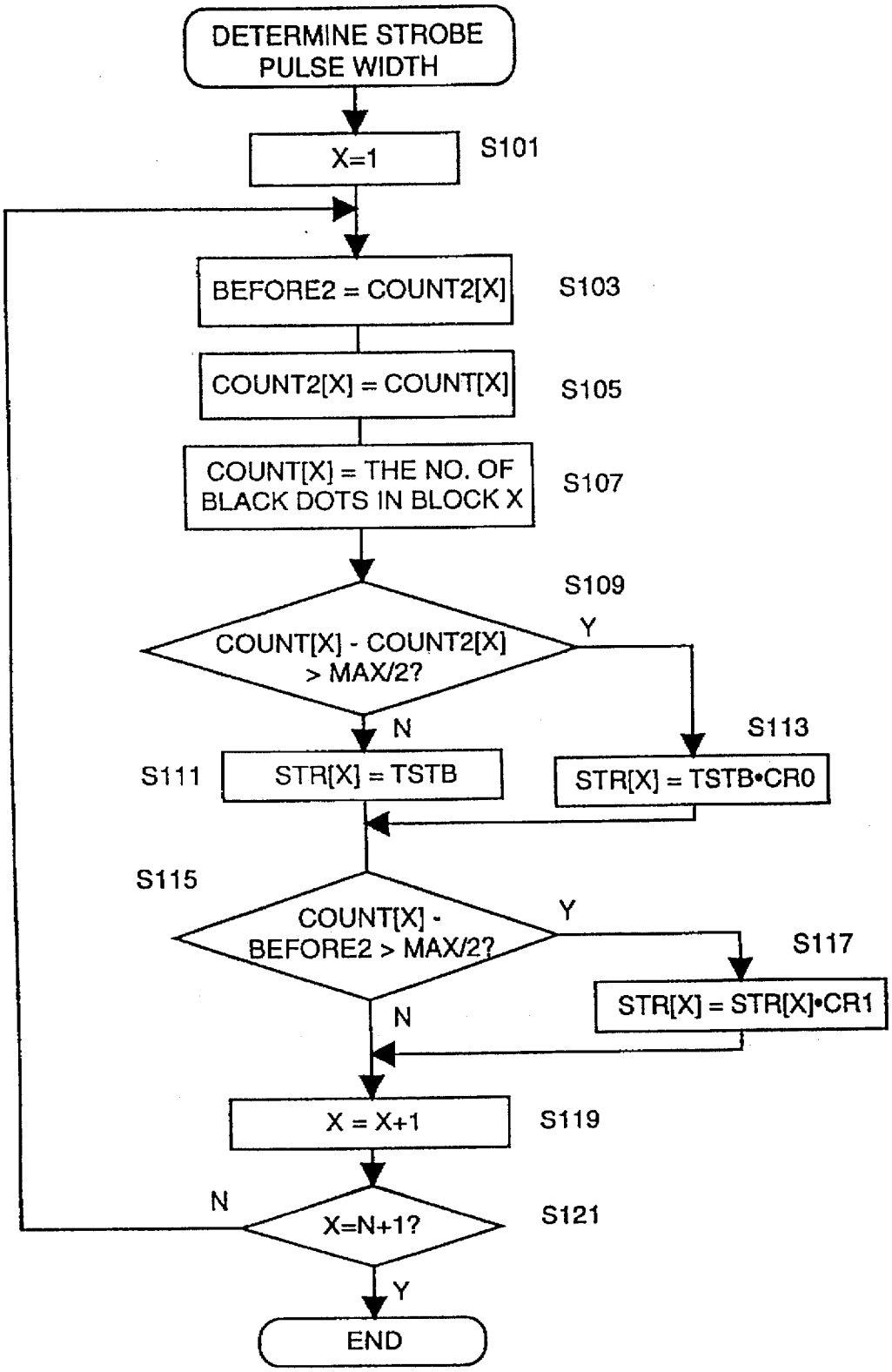
FIG. 6 shows a flowchart of a printing operation of the thermal printer according to another embodiment of the present invention.

FIG. 6 shows a flowchart of a process to determine a strobe pulse width according to a second embodiment of the present invention. In the second embodiment, the strobe pulse width STR[X] is determined in accordance with the number of thermal elements to be driven in the current line, and the number of thermal elements driven in the previous two lines.

In step S101, the value of X is initialized and set to 1. In step S103, the variable BEFORE2 is set equal to the number of lines driven in the line before the previous line (i.e., the previous value of the variable COUNT2[X]). Then in step S105, the value of the variable COUNT2[X] is set equal to the previous value of the variable COUNT[X]. COUNT2[X] is the number of black dots in the line which is two lines before the current line, while COUNT[X] is the number of black dots in the line which is printed before the current line. The number of black dots to be printed corresponds to the number of thermal elements to be driven.

In step S107, the number of black dots in BLOCK X is determined. Then, in step S109, the difference between COUNT[X] and COUNT2[X] is determined and compared with the value MAX/2. MAX is the total number of thermal elements that can be driven for each block of data. If COUNT[X]−COUNT2[X] is less or equal to than MAX/2 (S109:N), then the strobe pulse width STR[X] is set equal to TSTB in step S111.

However, if COUNT[X]−COUNT2[X] is greater than MAX/2 (S109:Y), then the strobe pulse width STR[X] is set equal to TSTB×CR0 in step S113. CR0 is a first compensation ratio used to compensate the strobe pulse width, in order to overcome the low residual heat of the thermal head 40 when the current line is printed. CR0 is greater than 1, and takes into consideration the number of thermal elements driven to print the line previous to the current line. In this step, therefore, the strobe pulse width STR[X] is modified if a difference in the number of thermal elements driven in the previous line, and a number of thermal elements to be driven in the current line, is larger than a predetermined value (i.e., MAX/2).

In step S115, the difference between COUNT[X] and BEFORE2 is determined and compared with the value MAX/2. MAX is the total number of thermal elements that can be driven for each block of data. If COUNT[X]−BEFORE2 is less than MAX/2 (S115:N), then the strobe pulse width STR[X] remains unchanged.

However, if COUNT[X]−BEFORE2 is greater than MAX/2 (S115:Y), then the strobe pulse width STR[X] is multiplied by CR1, in step S117, CR1 is a second compensation ratio, used to compensate the strobe pulse width, to further overcome the low residual heat of the thermal head 40 when the current line is printed. CR1 is greater than 1, and takes into consideration the number of thermal elements driven to print the line which is two lines before the current line. In this step, therefore, the strobe pulse width STR[X] is modified if a difference in the number of thermal elements driven in the line which is two lines before the current line, and a number of thermal elements to be driven in the current line, is larger than a predetermined value (i.e., MAX/2).

Then in step S119, the value of X is incremented by 1. Step S121 then determines if X=N+1, where N is the number of blocks. In this embodiment, N=4, therefore if X=5, the process ends. Otherwise, control passes to step S103, where the steps S103 through S119 are repeated.

Therefore, as described above, the strobe pulse width STR[X] is modified if the number of black dots to be printed in a block of a current line is larger, by a predetermined amount, than the number of black dots printed in the same block of the previously printed line and/or the number of black dots printed in the same block of the line printed two lines before the current line. This further improves the uniformity of darkness in the image formed by the thermal printer.

The present disclosure relates to subject matter contained in Japanese Patent Application No. HEI 6-151485 filed on Jun. 9, 1994 which is expressly incorporated herein by reference in its entirety.

What is claimed is:

1. A thermal printer for forming an image on a sheet, said thermal printer comprising:

a thermal head having a plurality of linearly arranged thermal elements;

determining means for determining a number of said thermal elements to be driven to form a line image;

calculating means for calculating a time period for which said thermal elements are driven to form said line image, in accordance with a number of said thermal elements driven to form a previous line image and said number of said thermal elements determining by said determining means to be driven to form said line image; and driving means for driving said thermal elements for said time period calculated by said calculating means to form said line image.

2. The thermal printer according to claim 1, wherein said image has a plurality of lines, each of said lines having image data, said image data divided into a plurality of blocks, wherein said determining means comprises means for counting a number of dots to be printed for a corresponding one of said plurality of blocks of image data, and wherein said number of thermal elements to be driven is determined in accordance with said number of dots.

3. The thermal printer according to claim 1, further comprising first storing means for storing said number of thermal elements driven to form said previous line.

4. The thermal printer according to claim 3, wherein when said number of thermal elements to be driven is not greater than said number of thermal elements driven to form said previous line by a predetermined amount, said time period is set to a first predetermined time value.

5. The thermal printer according to claim 4, wherein when said number of thermal elements to be driven is greater than said number of thermal elements driven to form said previous line by said predetermined amount, said time period is set equal to a second predetermined time value, said second predetermined time value being greater than said first predetermined time value.

6. The thermal printer according to claim 5, wherein said second predetermined time value is equal to said first predetermined time value multiplied by a compensation ratio.

7. The thermal printer according to claim 1, further comprising means for controlling a width of a strove pulse used by said driving means to vary said time period.

8. The thermal printer according to claim 7, further comprising means for storing said number of thermal elements driven to form said previous line, wherein said width of said strobe pulse is determined to be a predetermined time interval when said number of thermal elements to be driven is not greater than said number of thermal elements driven to form said previous lines by a predetermined amount.

9. The thermal printer according to claim 8, wherein said width of said strobe pulse is determined by increasing said predetermined time interval when said number of thermal elements to be driven is greater than said number of thermal elements driven to form said previous line by said predetermined amount.

10. The thermal printer according to claim 3, further comprising second storing means, wherein said first storing means stores a first number of said thermal elements driven to form a previously printed line, and said second storing means stores a second number of thermal elements driven to form a line before said previously printed line.

11. The thermal printer according to claim 10, wherein said calculating means calculates said time period that said driving means drives said thermal elements in accordance with whether said number of thermal elements to be driven is larger, by a predetermined amount, than said first number of thermal elements, and whether said number of thermal elements to be driven is larger by said predetermined amount, than said second number of thermal elements.

12. The thermal printer according to claim 11, wherein when said number of thermal elements to be driven is not greater than said first number by said predetermined amount, and said number of thermal elements to be driven is not greater than said second number by said predetermined amount, said time period is set to a first predetermined time value.

13. The thermal printer according to claim 12, wherein when said number of thermal elements to be driven is greater than said first number by said predetermined amount, and said number of thermal elements to be driven is not greater than said second number by said predetermined amount, said time period is set equal to a second predetermined time value, said second predetermined time value being greater than said first predetermined time value.

14. The thermal printer according to claim 13, wherein said second predetermined time value is equal to said first predetermined time value multiplied by a first compensation ratio.

15. The thermal printer according to claim 12, wherein when said number of thermal elements to be driven is greater than said first number by said predetermined amount, and said number of thermal elements to be driven is greater than said second number by said predetermined amount, said time period is set equal to a third predetermined time value, said third predetermined time value being greater than said second predetermined time value.

16. The thermal printer according to claim 15, wherein said third predetermined time value is equal to said second predetermined time value multiplied by a second compensation ratio.

17. A method of controlling driving of a thermal head of a printer for forming an image on a thermosensitive sheet, said thermal head having a plurality of linearly arranged thermal elements, said method comprising the steps of:

counting a number of said thermal elements to be driven to form a line of said image to be printed;

storing at least a number of said thermal elements driven to form at least a previously printed line of said image;

determining a time interval for driving said thermal elements, said time interval being determined in accordance with whether said counted number of thermal elements is larger than said at least stored number of thermal elements by a predetermined value; and driving said thermal elements that are to be driven to form said line of said image for said time interval.

18. The method according to claim 17, wherein said storing step stores a first number of said thermal elements driven to form a previously printed line, and a second number of thermal elements driven to form a line before said previously printed line.

19. The method according to claim 18, wherein said determining step determines said time interval in accordance with whether said number of thermal elements to be driven is larger than said first number of thermal elements by said predetermined value, and whether said number of thermal elements to be driven is larger than said second number of thermal elements by said predetermined value.

20. The method according to claim 19, wherein when said number of thermal elements to be driven is not greater than said first number by said predetermined amount, and is not greater than said second number by said predetermined amount, said time interval is set to a first predetermined time value.

21. A thermal printer for forming an image on a sheet, said thermal printer comprising:

a thermal head having a plurality of linearly arranged thermal elements;

means for determining a number of said thermal elements to be driven to form a line image;

means for calculating an amount of heat to be output by said thermal elements to form said line image, said amount of heat being determined in accordance with a number of said thermal elements driven to form a previous line image and said number of said thermal elements to be driven to form said line image; and means for driving said thermal elements to form said line image in accordance with said amount of heat determined by said determining means.

22. A thermal printer for forming an image on a sheet, said thermal printer comprising:

a thermal head having a plurality of linearly arranged thermal elements, said thermal elements being divided into a plurality of groups;

means for determining a number of said thermal elements of each of said plurality of groups to be driven to form a line of an image to be printed;

means for storing a number of said thermal elements to be driven in each of said plurality of groups to form a previously printed line of said image;

means for driving said thermal elements of each of said plurality of groups that are to be driven to form said line of said image to be printed; and means for modifying a time interval that said driving means drives each of said plurality of groups of said thermal elements, said time interval being modified in accordance with whether said number of thermal elements to be driven in each of said groups is larger, by a predetermined value, than said number of thermal elements previously driven in each of said plurality of groups.

* * * * *

UNITED STATES PATENT AND TRADEMARK OFFICE

CERTIFICATE OF CORRECTION

PATENT NO. : 5,677,721

DATED : October 14, 1997

INVENTOR(S) : M. SUZUKI et al.

It is certified that error appears in the above-indentified patent and that said Letters Patent is hereby corrected as shown below:

At column 9, line 29 (Claim 1, line 11), change "determining" to ---determined---.

Signed and Sealed this

FourthDay of August, 1998

Bruce Lehman

*Attest:*

BRUCE LEHMAN

*Attesting Officer*

*Commissioner of Patents and Trademarks*